US005277662A

United States Patent [19]

Fox et al.

[11] Patent Number: 5,277,662

[45] Date of Patent: * Jan. 11, 1994

[54] SYSTEM AND METHOD OF PROVIDING PASSENGER INGRESS AND EGRESS IN AN AMUSEMENT RIDE HAVING PIVOTABLE BRIDGES

[75] Inventors: Richard J. Fox, La Canada; Maurice G. Leasure, Sun Valley; Gregory S. Kadorian, Simi Valley; Douglas R. LeBlanc, Tujunga; David L. Harbaugh, La Mirada; James E. Poole, Topanga, all of Calif.

[73] Assignee: The Walt Disney Company, Burbank, Calif.

[ * ] Notice: The portion of the term of this patent subsequent to Nov. 3, 2009 has been disclaimed.

[21] Appl. No.: 916,945

[22] Filed: Jul. 20, 1992

Related U.S. Application Data

[63] Continuation of Ser. No. 710,518, Jun. 3, 1991, Pat. No. 5,161,104, which is a continuation of Ser. No. 141,933, Jan. 11, 1988, Pat. No. 5,021,954.

[51] Int. Cl.[5] ..... G01N 9/00

[52] U.S. Cl. ..... 472/136; 104/35; 104/53; 104/73; 414/590

[58] Field of Search ..... 104/20, 30, 31, 53, 104/73, 82; 364/410-; 472/3, 2, 44, 46, 47; 250/289; 414/287, 288, 589, 921; 198/321, 324

[56] References Cited

U.S. PATENT DOCUMENTS

| | | |
|---|---|---|
| 797,095 | 8/1905 | Boyce . |
| 809,589 | 1/1906 | Timmons . |
| 818,304 | 4/1906 | Shaw . |
| 872,627 | 12/1907 | Keen . |
| 892,070 | 6/1908 | Murphy . |
| 1,037,474 | 9/1912 | Gunzendorfer . |
| 2,750,135 | 6/1956 | Anderson . |
| 2,756,686 | 7/1956 | Kendall et al. . |
| 2,778,674 | 1/1957 | Attendu . |
| 3,006,008 | 10/1961 | Loomis et al. . |
| 3,185,108 | 5/1965 | Muller . |
| 3,628,829 | 12/1971 | Hellig . |
| 3,633,904 | 1/1972 | Kojima . |
| 3,865,041 | 2/1975 | Bacon . |
| 4,066,256 | 1/1978 | Trumball . |
| 4,084,713 | 4/1978 | Rohrs et al. . |
| 4,133,067 | 1/1979 | Bennett et al. . |
| 4,142,640 | 3/1979 | Kummerman . |
| 4,222,140 | 9/1980 | Olewinski et al. . |
| 4,296,516 | 10/1981 | Jarnum . |
| 4,425,851 | 1/1984 | Long . |
| 4,473,916 | 10/1984 | Connold . |
| 4,700,632 | 10/1987 | Schmutz . |
| 4,843,970 | 7/1989 | Feuz . |

FOREIGN PATENT DOCUMENTS

| | | |
|---|---|---|
| 452235 | 3/1913 | France . |
| 188158 | 11/1922 | United Kingdom . |
| 705374 | 3/1954 | United Kingdom . |

*Primary Examiner*—Carl D. Friedman
*Assistant Examiner*—Kien Nguyen
*Attorney, Agent, or Firm*—Pretty, Schroeder, Brueggemann & Clark

[57] ABSTRACT

A method and system is provided for moving passengers in and out of an amusement ride of the type having a passenger cabin capable of movement in multiple degrees of freedom within an enclosure. The cabin includes ingress doors on one side of the cabin and egress doors on the other side to admit and discharge passengers from seats within the cabin. Another set of ingress and egress doors are provided on opposite sides of the enclosure in respective alignment with the ingress and egress doors of the cabin when the cabin is at rest in a loading position. A plurality of ingress and egress platforms, located outside the operating envelope of the cabin when the cabin is in motion, are adapted to be moved to a deployed position when the cabin is in the loading position to connect the ingress and egress doors of the enclosure with the ingress and egress doors of the cabin. In this way, movement of passengers in and out of the cabin, which is spaced from the enclosure, is provided in a rapid and orderly fashion. Control means in the form of a computer also are included for controlling and coordinating the various movements of the doors, platforms and cabin. Restraints in the passenger seats also can be controlled by the computer so that the amusement ride cannot begin until the restraints in each occupied seat are fastened.

14 Claims, 5 Drawing Sheets

FIG. 4.
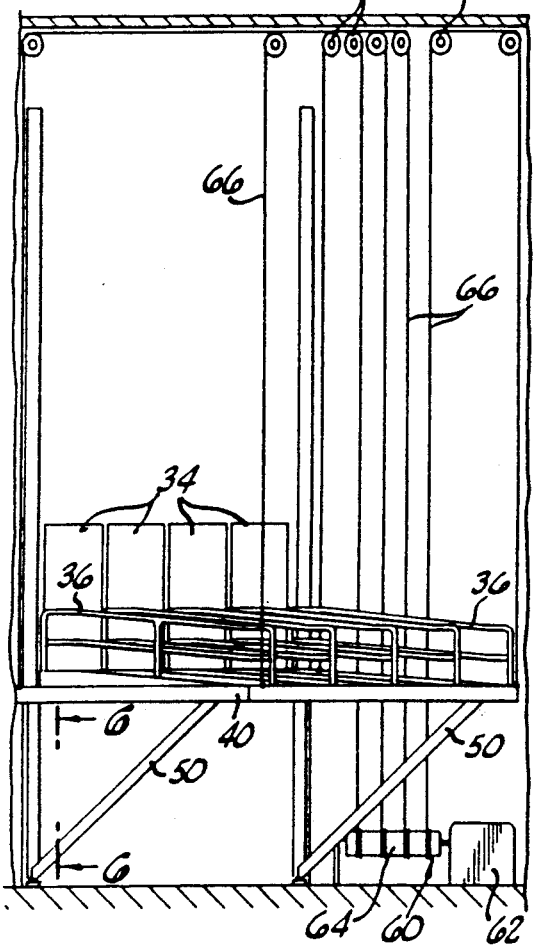
FIG. 5.
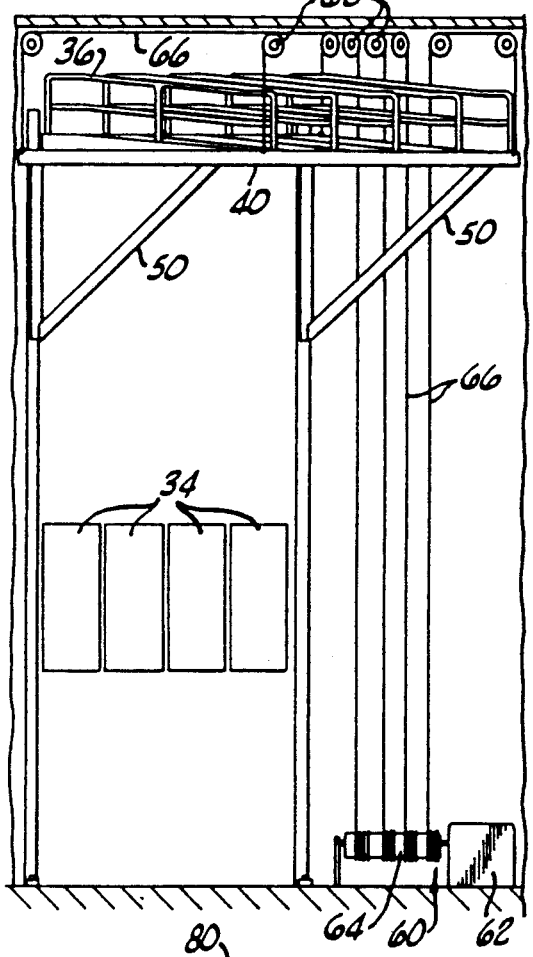
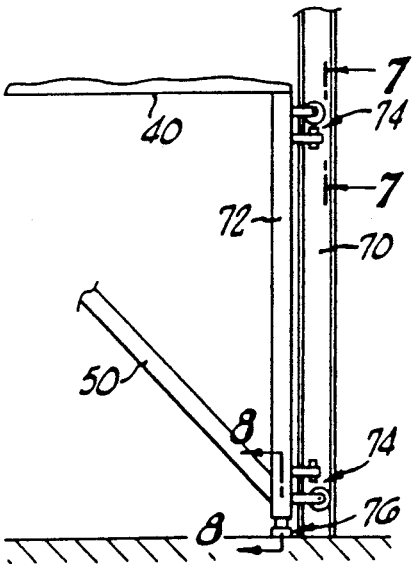
FIG. 6.
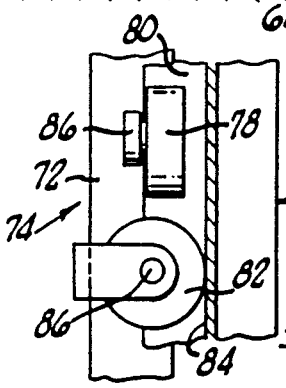
FIG. 7.
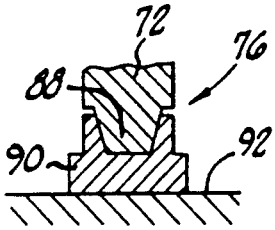
FIG. 8.

SYSTEM AND METHOD OF PROVIDING PASSENGER INGRESS AND EGRESS IN AN AMUSEMENT RIDE HAVING PIVOTABLE BRIDGES

This is a continuation of application Ser. No. 710,518, filed Jun. 3, 1991, now U.S. Pat. No. 5,161,104, which is a continuation of application Ser. No. 141,933, filed Jan. 11, 1988, now U.S. Pat. No. 5,021,954.

BACKGROUND OF THE INVENTION

Amusement rides that utilize passenger cabins which are capable of movement with multiple degrees of freedom (roll, pitch, yaw, vertical, lateral and longitudinal motion) have recently become popular due to their ability to provide exciting rides in relatively small areas. However, such amusement rides present many difficulties associated with their safe operation and economics. Previous amusement rides that utilized tracked vehicles used loading facilities which incorporated loading platforms located in a designated loading area adjacent to the tracks upon which the vehicle runs. Such a system utilizes direct access of the patron into the moveable vehicle by allowing the patron to step directly into the vehicle when it is brought to rest in the loading area. Thereafter, the operator of the ride manually assures that safety systems, such as seatbelts and other restraints, are engaged prior to departure of the vehicle from the loading platform area. Similarly, non-tracked rides such as ferris wheels and other rotary or oscillating rides have utilized a waiting area and loading zone to which the passenger vehicles are progressively brought, stopped and loaded.

While such access systems have proven useful and practical for a wide variety of relatively simple rides, they are relatively limited in their applicability due to the fact that the vehicle must be brought to a slow and controlled stop next to the boarding platform on which the next load of patrons is waiting. However, the stationary loading platform approach is not readily applicable to non-tracked vehicles that must operate at high speed in close proximity to the platform, especially if such vehicles are capable of movement in a direction lateral to the loading platform.

The adaptation of multiple degree of freedom motion simulators as a basis for amusement rides has presented a variety of problems, among them rapid, economical and safe means of providing access by patrons to the ride. Amusement rides which use cabin vehicles that are maneuvered in multiple degrees of freedom must be enclosed within a structure which prevents access to the operating envelope of the vehicle by patrons or other unauthorized persons in order to prevent the risk of severe injury which would occur should a person be trapped within the operating envelope of the vehicle once the ride has begun. Large cabin vehicles of the type that are utilized in theme parks and other major attractions present enormous risks in that the potential force and velocity of the rides cannot be overcome by any human force and, once set in motion, are not susceptible to immediate cesation of all motion when operating at high speed without injury to the operators, structure, occupants, or some combination thereof.

Furthermore, such moving cabin rides represent a very large investment due to their use of hydraulic and electronic power systems and their extensive use of advanced technology, including computers. Such systems were developed, in part, from simulators used to train pilots and other operators of expensive vehicles, primarily to avoid the risks associated with losing such an expensive vehicle during experimental or training exercises. For that reason, rapid ingress and egress of a large number of passengers was neither necessary nor desirable, since the simulator could only be effectively and economically used by a relatively small number of people over a relatively large period of time, and the simulator was much less expensive to use than the aircraft or other vehicle being simulated. The first uses of such moving simulators as amusement rides incorporated the simple door and access plank developed for the simulators, but the economics for such an installation were not justifiable to major theme parts in light of the relatively limited space available for such systems, the cost of the equipment and physical plant associated with the installation and the probability of client alienation associated with excess wait time to enjoy the attraction. Furthermore, the relatively simple loading systems available for amusement rides could not be adapted to the simulator based systems, since the operating envelope of the simulator could not be intruded into, and such systems as were available were all deficient in providing high capacity access without interfering with the operating envelope.

For these reasons there remains a need for a rapid, economical, safe and relatively high capacity ingress-egress system for a moving cabin and other high energy, high cost amusement rides that present the above requirements.

SUMMARY OF THE INVENTION

Ingress-egress systems for amusement rides must provide rapid and easy access to the ride in a carefully controlled environment and still prevent unnecessary risk of harm to the patron. When these requirements are combined with the use of a large moving cabin simulator that is capable of movement in six degrees of freedom, with the resultant large envelope which must be cleared prior to activation of the simulator, conventional and simple methods of access to such amusement rides become impractical. Furthermore, reliance upon a human operator to determine that seat belts or other restraints are physically engaged prior to activation of the moveable cabin, which can produce high accelerations about all axes, is insufficient to guarantee safety of the patron during the ride. The damage which may occur in the event that a partial failure or differential activation of the access system were to occur emphasizes the fact that simple patron access systems of the type previously used for such amusement rides are inadequate in todays environment of higher cost effectiveness and safety requirements. Furthermore, the great cost of multiple degree of freedom simulators to be used as amusement rides justifies a higher capacity access system, even though it may be more complex and costly than a simple system.

The present invention is embodied in a combination of high speed retractable access platforms combined with a door configurations in the cabin and enclosure structure, and interlocking system systems for the door platforms and restraint systems that provide previously unavailable levels of patron throughput and safety for multiple degree of freedom moving base amusement rides.

According to the invention, a plurality of doors is arranged on opposite sides of the cabin at each end of the aisles adjacent each row of seats in the cabin. The doors are activated by a control system that coordinates their opening with the deployment of high speed movable access platforms that are retracted beyond the operating envelope of the moving base amusement ride when it is in operation. In a preferred embodiment, the floor of the amusement ride is either stepped or sloped downwards from back to front to allow unrestricted viewing by the patron of a scene projected in front of the moving cabin. Each of the access aisles are thus displaced vertically in step-wise fashion from the back of the cabin to the front and their respective access doors are positioned so that their bottom edges are aligned with the surface of the aisled of their respective row.

Immediately after the passenger cabin is brought to a rest at the completion of the ride, the platforms are rapidly moved from their rest position outside of the operating envelope of the cabin to a position in alignment with the doors. The platforms are configured so that their respective entry aisles are aligned vertically and laterally with the position of the doors and their associated aisles. When the central ride control computer is provided with sensor information that the access platforms have been positioned in alignment with appropriate indexing positions, the doors are opened and patrons who have enjoyed the ride may move out of the cabin through one set of doors while those entering the amusement ride are granted entrance to the cabin through the doors on the opposite side of the cabin. The moveable loading platforms, in turn, are lowered and aligned with the moveable cabin and the enclosure doors to create a path for ingress and egress to the cabin via the moving platforms. The doors to the stationary loading ramps outside the enclosure are likewise controlled by the ride control computer and are opened after the moveable platforms have come to rest in alignment with the cabin doors and the enclosure doors upon completion of the ride.

Thus, after the ride has been completed, the invention provides for a tightly controlled sequence of stopping the passenger cabin, deploying the high speed access platforms and opening the doors in a coordinated fashion after the platforms, cabin and outer doors are properly aligned, thereby allowing the patrons to proceed via the aisles between the seats into and out of the cabin via the ingress and egress doors located on opposite sides of the cabin.

After the entering patrons have been seated, a central control system will not allow initiation of the cabin closing sequence prior to the beginning of the ride until all of the passenger restraints for occupied seats are engaged. Thus, the sequence initiating the beginning of the ride can only begin after the passengers are positively restrained. A control panel illustrating the status of the restraints may also be provided so that a human operator may cross check the system operation and ascertain the location of disengaged restraint systems. After the restraint systems are engaged, the operator leaves the passenger cabin and, upon reaching his station outside of the ride enclosure, actuates a switch which begins the closing sequence. The doors to the cabin and to the external platforms are closed; then the high speed retractable loading platforms are retracted out of the operating envelope of the cabin and the ride begins.

It may be seen from the above description that the present invention provides a highly automated and efficient means of providing ingress and egress to moving cabin amusement rides while providing a high degree of safety and automation necessary for rides which are capable of rapid motion and multiple degrees of freedom within an enclosed area. In order to increase the inherent safety associated with the invention, failsafe design and redundancy is provided in all of the critical control systems and emergency stop functions are provided in the event of a failure of any critical system.

Other features and advantages of the invention will become apparent from the following detailed description taken in conjunction with the accompanying drawings, which illustrate, by way of example, the features of the invention.

BRIEF DESCRIPTION OF THE DRAWINGS

FIG. 4 is a side elevation view at section 4—4 of FIG. 2, showing the retraction mechanism for the access bridges.

FIG. 5 is a side elevational cross section similar to FIG. 4, illustrating the position of the access bridges when they are in their retracted position.

FIG. 6 is a section at 6—6 of FIG. 4 illustrating the rail and guide system for the access bridges in the guide rails in the side of the ride housing.

FIG. 7 is a section at 7—7 of the guide rail system illustrating the guide rollers and their relationship to the guide rail system.

FIG. 8 is a section at 8—8 of FIG. 6, illustrating the stop locating pad for the access bridge system.

DETAILED DESCRIPTION

Figure 1:
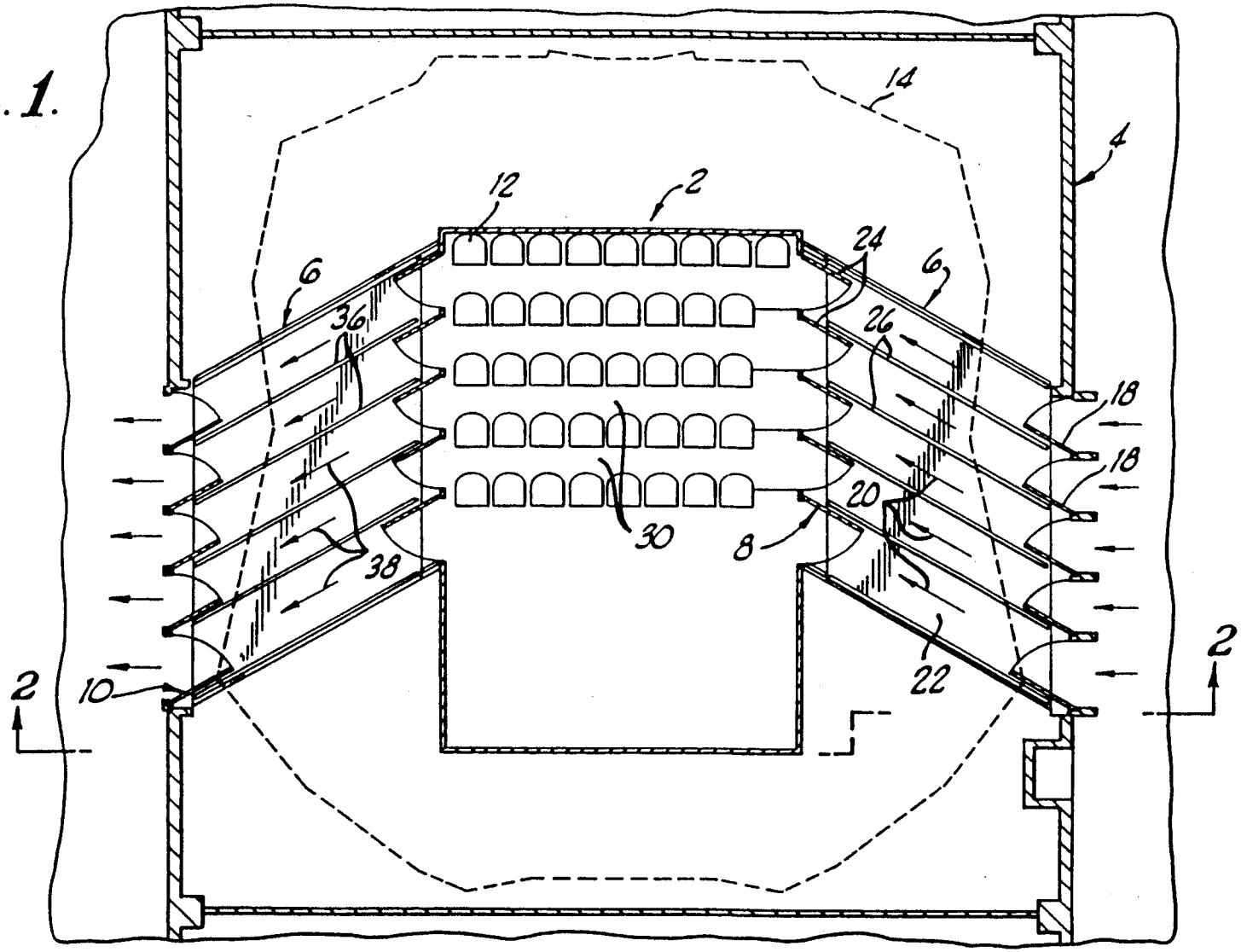
FIG. 1 is a top elevational view of an amusement ride ingress-egress system according to the present invention, illustrating the relationship of the passenger cabin, the ride enclosure and the ingress-egress system components.

As shown in the exemplary drawings, the present invention provides a means of rapid and high volume access to a passenger cabin 2 from the exterior of structure 4 by use of retractable bridges 6 that match with cabin doors 8 and enclosure doors 10 to provide controlled access to patron's seats 12. The cabin 2 is capable of movement in multiple degrees of freedom (roll, pitch, yaw, x,y,z) through operating envelope 14. A ride control computer 16 monitors sensors and controls the safety interlock system that provides the required deployment sequence of the ingress-egress system and prevents the starting of the ride until each passenger that occupies a seat has fastened a safety restraint and the ingress-egress system has been retracted to an area outside the envelope. Thus, the present invention provides the benefits of very high throughput while limiting the potential for damage to the ride, its access system or the patrons.

The availability of multiple degree of freedom flight simulators has created the opportunity to provide amusement rides that can expose the passengers to a wide variety of motion cues without leaving a single central facility. When the capability to provide a wide variety of visual cues is included, the potential for such simulators as amusement rides is very promising. However, simulators have generally been designed to provide training for aircraft and other expensive vehicles and most of this training was to be provided to a relatively small number of people who were to use the simulator for a relatively large period of time. The requirement to rapidly turn over the number of people to use such a simulator for an approximately 5 minutes amusement ride created new pressures previously ignored or unrecognized to allow rapid and safe access of the patrons to the passenger cabin during the change over between shows. Since such a simulator is extremely expensive, the entire economics of employing a six degree of freedom simulator as an amusement ride rested with the ability to provide rapid ingress and egress by patrons in a safe and reliable manner. The present invention provides such safe and reliable access without in any way inhibiting the capabilities of the simulator and its use as an amusement ride.

FIG. 1 is a top plan view illustrating passenger cabin 2 within the ride enclosure 4 with access bridges 6 in place. Cabin doors 8 and enclosure doors 10 are shown opened to the position in which they provide rapid access to passenger seats 12. When retracted, platform 6 retreat beyond the operating envelope 14 of the simulator, thereby providing free movement of cabin 2 within its design parameters. As shown by the arrows, access of the patrons is uni-directional from ingress doors 18 along aisles 20 on ingress platform 22 to ingress cabin doors 24. Access is guided by ingress platform rails 26 that define the aisles 20 on the platform 22 and match with aisles 30 between the rows of patron seats 12. Similarly, egress doors 32 in the cabin and enclosure egress doors 34 in the enclosure mate with egress platform rails 36 to define egress aisles 38 on egress bridge 40. In the sequence of operations according to the invention, the cabin 2 is brought to a rest position at which time platform 22 and 40 are deployed to a position in alignment with the openings defined by the cabin doors 8 and enclosure doors 10. When the platform are at the appropriate position and the sensors so indicate, the ride control computer actuates all of the egress doors, thereby providing an egress path for the patrons who have experiences the ride. As soon as practicable thereafter, the ingress doors are opened and the incoming load of passengers is provided access to the cabin preparatory to the ride beginning. When all of the entering passengers have been seated and have actuated their seat restraints (not shown here), the status is displayed on a panel for manual verification by the ride operator and, if all safety systems are secured, the ride control computer is allowed to proceed with retraction of the ingress-egress system after the ride operator has indicated to the ride control computer that he is at his station. Thereafter, the ride operator closes the doors and inputs a request to the ride control computer that the ride start. If the ride control computer (RCC) has received information from the appropriate sensors that the ride is safe to begin motion and that all passenger safety restraints are engaged, the RCC then retracts the platforms and begins the ride. Thereafter, the doors are closed and once the doors are closed, platforms 6 are retracted to a position outside of operating envelope 14. The ride control computer is provided an indication that the retraction process is complete and the beginning of the ride is then initiated.

Figure 2:
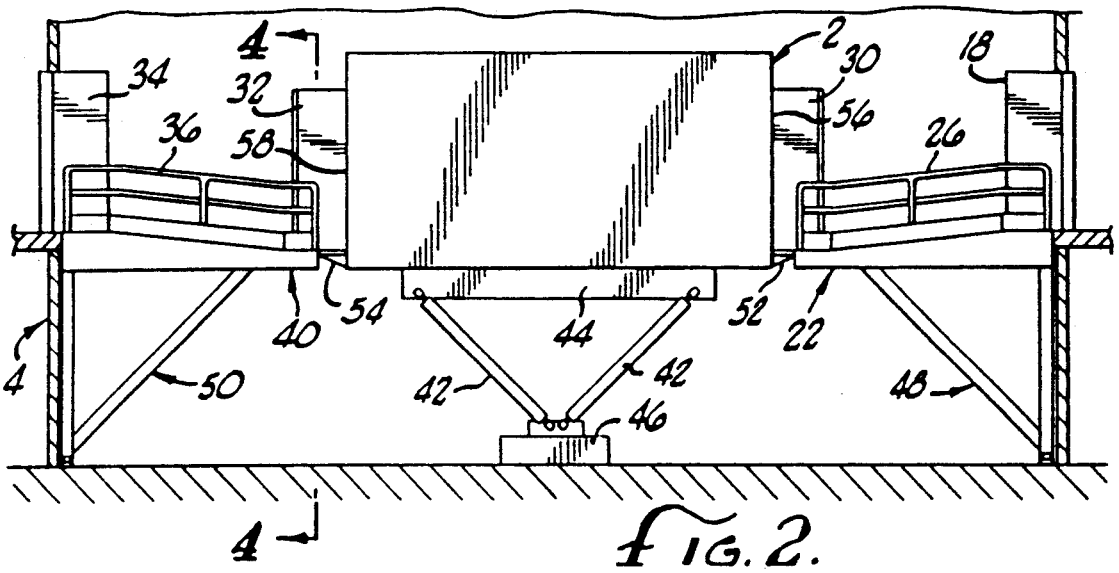
FIG. 2 is a cross section of an ingress-egress system according to the present invention at 2—2 of FIG. 1.

FIG. 2 is a cross sectional elevational view showing cabin 2 at its loading rest position in enclosure 4. This loading position corresponding to the position assumed by the cabin when the hydraulic pressure that drives actuators 42 is removed and the weight of the cabin drives the actuators to their collapsed position. When actuators 42 have carried cabin 2 to its rest position, and platforms 22 and 40 have been deployed, doors 18, 30, 32 and 34 are then opened, providing access to cabin 2 in combination with rails 26 and 36. Actuators 42 operate cabin 2 through cabin structure 44, the actuators being supported from a basic structure 46 located in the floor of the enclosure. Platforms 22 and 40 are supported by structure 48 and 50 respectively, thereby providing a rigid and stable structure for ingress and egress of the passengers when the cabin is in its loading position and the access platform are deployed. Aisle extensions 52 and 54 for the ingress and egress portions respectively, are designed to mate with platforms 22 and 40 to provide a smooth transition from the platforms to the cabin aisles without the necessity of directly interfacing the platforms with the side walls 56 and 58 respectively of the cabin structure.

Figure 3:
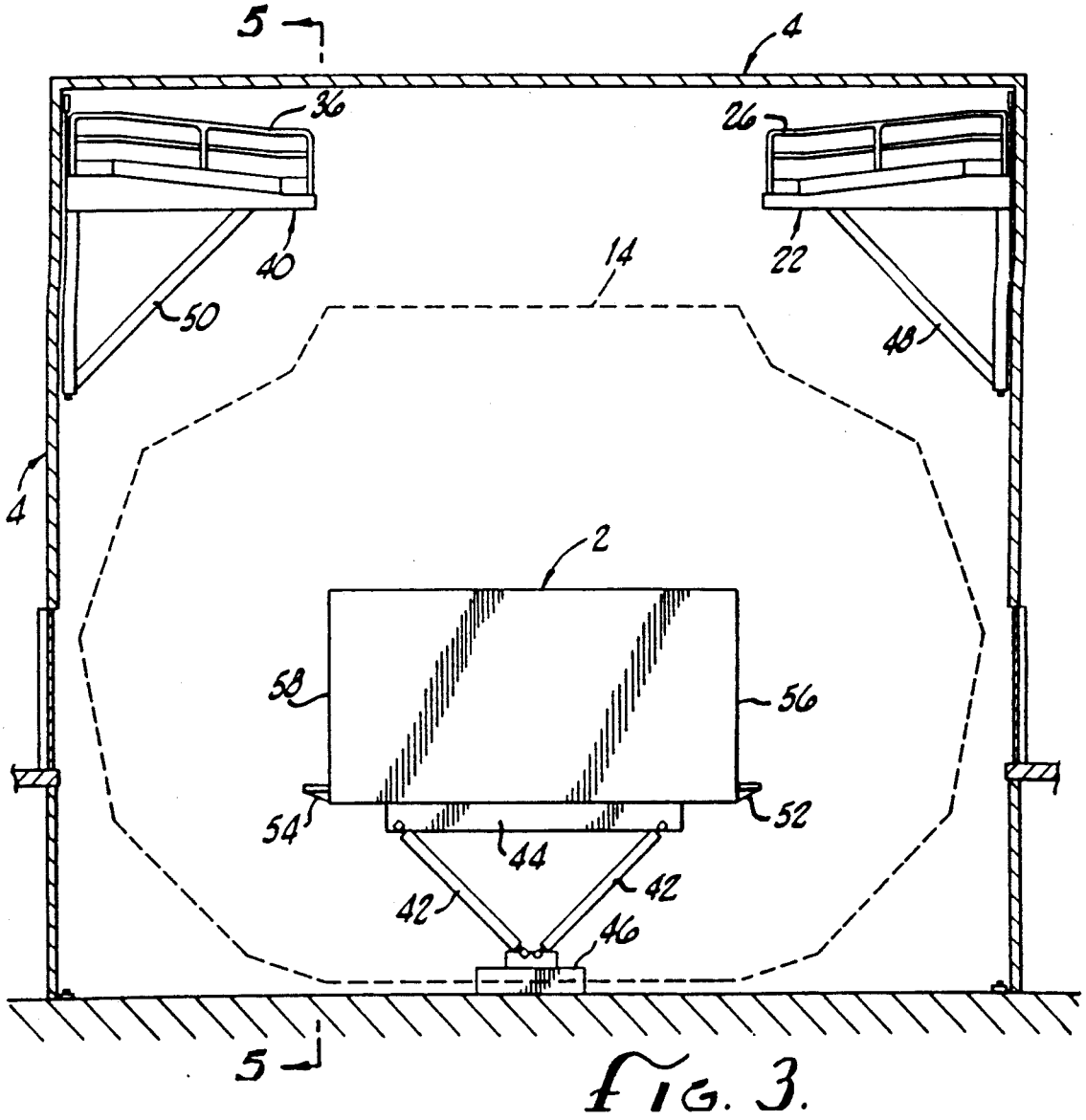
FIG. 3 is a cross section similar to FIG. 2, illustrating the arrangement of the access bridges when they are retracted beyond the operating envelope of the passenger cabin.

FIG. 3 illustrates the arrangement of the access platforms after they have been retracted to positions outside of the operating envelope 14 of the passenger cabin 2. Here, passenger cabin 2 is illustrated in the rest loading position in which actuators 42 have drawn down to their minimum heigth based on structure 46 and operating through cabin structure 44. It may be seen that the ingress and egress aisle extensions 52 and 54 remain attached to the cabin 2 and project from the cabin walls 56 and 58. Ingress structure 48 and egress structure 50 retract with the platform as a unit when the platform is pulled to its upper extremity in the retraction process.

FIG. 4 is a side elevational view at 4—4 of FIG. 2 and illustrates egress platform 40 in its deployed position. In this illustration, enclosure egress doors 34 are shown closed rather than deployed against egress platform rails 36. Egress structure 50, shown here partially eliminated for the sake of clarity, supports egress platform 40 away from the enclosure wall. A retraction mechanism generally designated 60 incorporates a drive system 62 which operates a cable drum 64 that winds cable 66 over a series of sheaves 68 to thereby retract or deploy bridge 40 between its deployed or retracted positions.

FIG. 5 illustrates the platform 40 retracted to its position outside of the operating envelope by use of retraction mechanism 60 incorporating drive system 62 driving cable drum 664. As previously described, cables 66 are then wound around cable drum 64 and retract platform 40 and supporting structure 50 to a retracted position when the cables 66 are wound over sheaves 68. As may be seen from this view, by use of this mechanism the platform structure may be completely withdrawn, leaving as the only obstruction the side wall of the ride housing.

FIG. 6 illustrates the mechanism by which the structure 50 and platform 40 interface with guide rail 70 of ride housing 4. FIG. 6 is a section at 6—6 of FIG. 4 and shows that the structure interfaces through a vertical member 72 that incorporates rollers, generally designated 74, and a stop locating pad 76 to provide for accurate translation of the platform 40 between its deployed and retracted systems.

FIG. 7 illustrates the arrangement of rollers 74 as they ride against guide rail 70. The upper roller 78 bears against surface 80 on guide rail 70, thereby preventing motion of the vertical member 72 inward into the enclosure. Similarly, roller 82 varies against surface 84 on guide rail 70 to prevent lateral motion of the structure relative to the vertical guide rail 70. Both rollers are mounted upon bearings 86 that are attached to vertical member 72 of structure 50.

FIG. 8 illustrates a cross sectional view of locating pad 76, illustrating how the male portion 88 of vertical member 72 fits into a mating female portion 90 mounted to the floor 92 of enclosure 4. Thus, when the structure of the bridge 40 is in its deployed position, the platform is positively located by locating pad 76.

Figure 9:
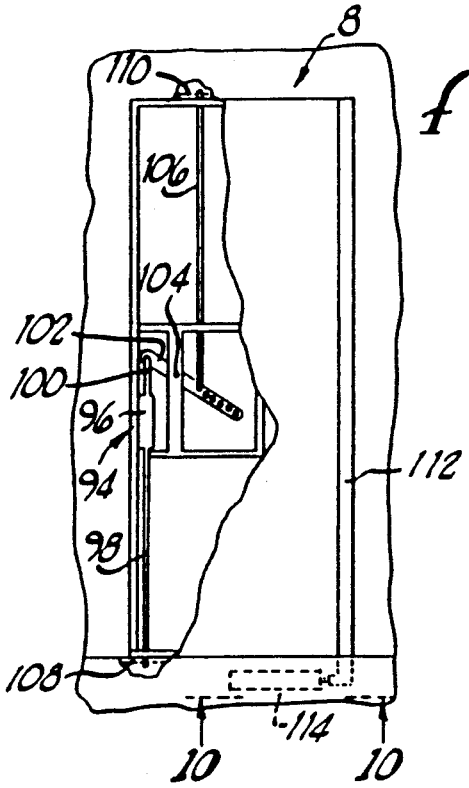
FIG. 9 is a cut away elevational view of a access door according to the present invention illustrating the door locking mechanism.

FIG. 9 is a cut away view of a door 8 of the type used in the present invention. The latch mechanism, generally designated 94, incorporates a linear actuator 96 that directly operates a locking pin 98 and operates a second locking pin 106. Locking pins 98 and 106 respectively interface with jamb plates 108 and 110 to lock the door when actuator 96 is engaged. Door 8 pivots about hinge 112 and is opened and closed by an actuator system generally designated 114.

Figure 10:
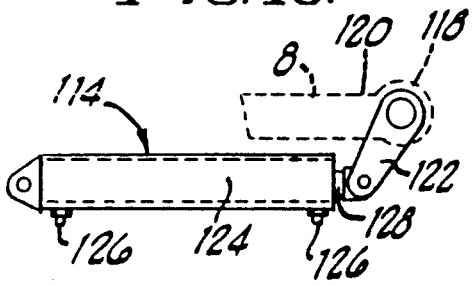
FIG. 10 is an illustration of the door accuation system as viewed from 10—10 of FIG. 9.

FIG. 10 illustrates the actuation means to open and close the door. As discussed above, hinge member 118 is attached to door 8 by structural extensions 120. Lever arm 122 is fastened to hinge member 118 and is moved by linear actuator 124 in response to air admitted through fittings 126 which drive actuation rod 128 in a linear direction, thereby rotating the doors open and closed.

Figure 11:
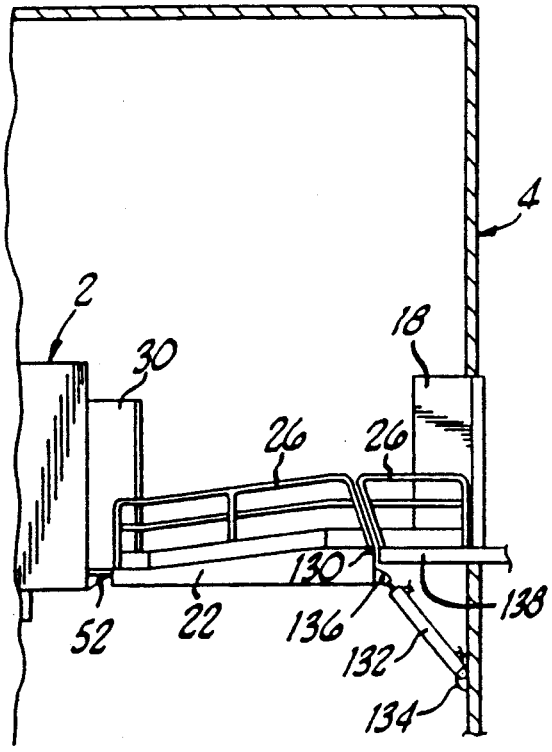
FIG. 11 is an alternative configuration of the present invention utilizing a pivoting drawbridge system instead of the retractable bridge of one preferred embodiment.

FIG. 11 illustrates an alternative embodiment of the present invention in which bridge 22 is pivotally retracted against the walls of enclosure 4 rather than being withdrawn vertically. Here, the relationship of rails 26 and pivot point 130 are arranged so that when the bridge is retracted, the rails 26 will not interfere with one another, nor will there be interference between any other portions of the bridge structure and the remaining structure within the enclosure or attached to the cabin. An actuator 132 pivotally attached to the wall at pivot point 134 and bridge structure 22 at the pivot point 136 is actuated to effect rotation of bridge 22 about pivot point 130 after ingress doors 18 and 30 have been closed. In the deployed position bridge 22 forms an extension of platform 138 and ingress isle extension 52 to complete the access required to the cabin. Those skilled in the art will recognize that other retractable platform systems and mechanisms, such as hydraulic elevators or rotating platforms in alternative configurations to those shown are contemplated by the invention and may be utilized as a means of platform retraction.

Figure 12:
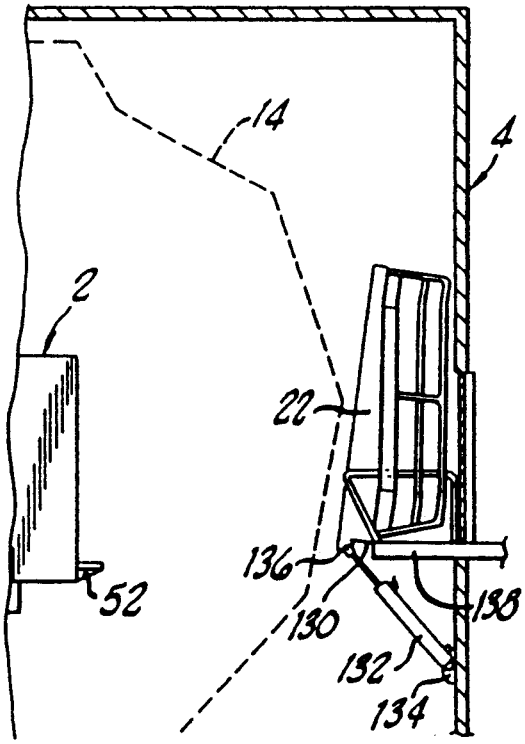
FIG. 12 illustrates the drawbridge system of FIG. 11 in its retracted position.

FIG. 12 illustrates platform 22 in its retracted position against the outside wall after linear actuator 132 has been extended to pivot platform 22 around pivot point 130. Thus, the platform 22 has retracted outside of operating envelope 14 to provide free movement of cabin 2 throughout its operating range.

Figure 13:
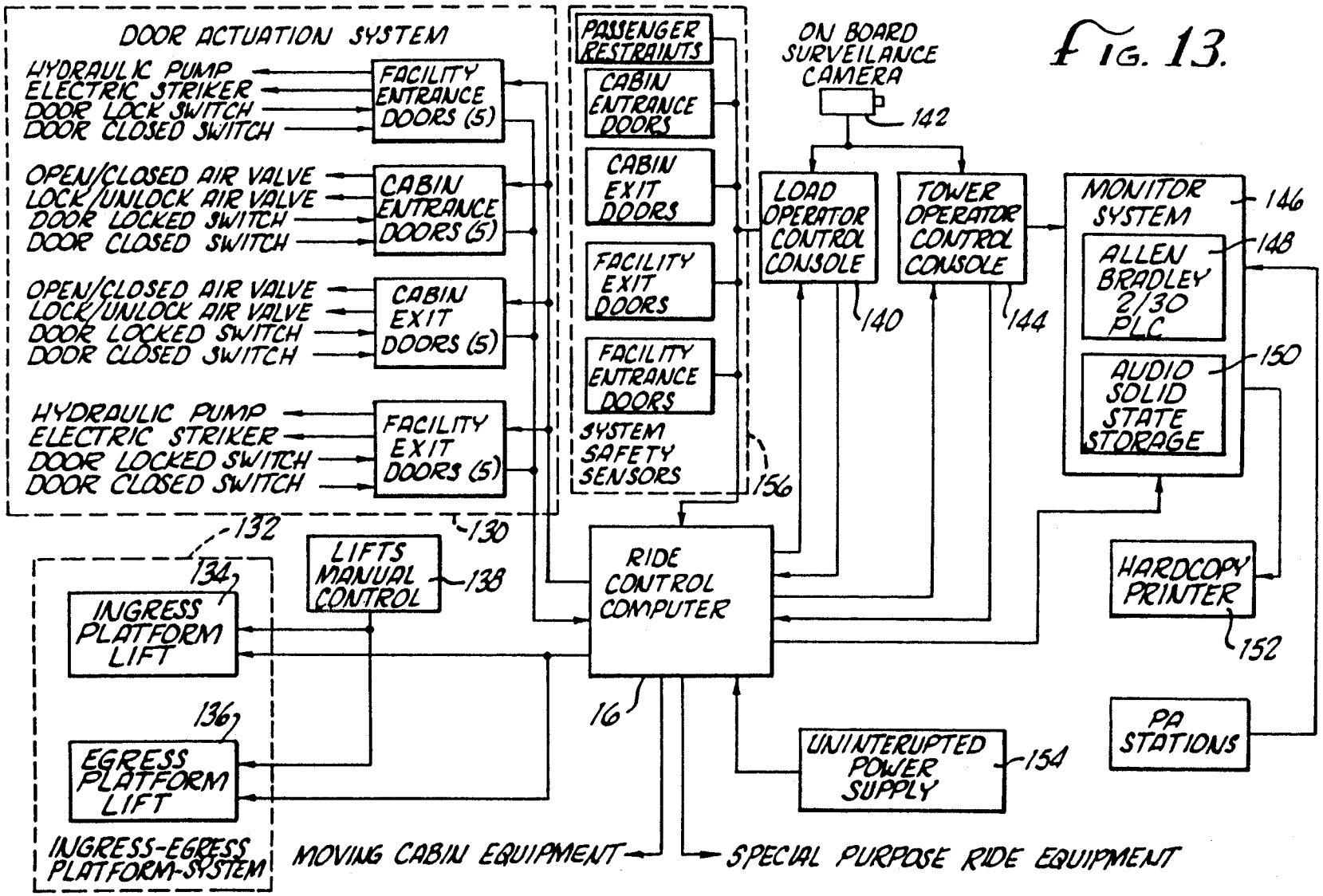
FIG. 13 is an operational schematic diagram illustrating the relationship of the various electromechanical and electronic portions of an amusement ride according to the present invention.

FIG. 13 illustrates a functional schematic of the electrical interfaces of the various basic components of the ingress-egress system with the ride control computer 16. The ride control computer 16 provides the primary means of controlling the door actuating sub-system 130, which incorporates both systems required to open and close the doors and the sensors required to provide the appropriate signals to the ride control computer that the doors are in position. Similarly, the ingress and egress platform system 132 incorporates both an ingress platform lift system 134 and an egress platform lift system 136. Provision is made for manual operation of the lifts when the ride is not in use.

An operator control console 140 is provided to allow the operator to interface with the ride control computer and to observe the interior of the cabin through the onboard surveilance camber 142. A similar control console 144 is provided for the tower operator, who acts as a backup observer. The monitor system monitors the Ride Control Computer(s) and generates fault messages for operations assistance and maintinence trouble-shooting. A hard copy printer 152 is provided to allow for the recording of the messages of the results of specific events during the ride. An uninterruptible power supply 154 is provided to assure that any interruption in the normal power supply to the ride control computer and the other systems will allow the drive system to safely shut down the ride.

The system safety sensors 156 provide input to the ride control computer to provide a positive indication that all doors are closed and occupied seat restraints are latched prior to initiation of the ride. Thus, the ride control computer sequences the deployment of the ingress and egress platforms prior to the opening of the access doors that meet with the platform. After the doors have been opened to meet with deployed ingress and egress platforms and the passengers have taken their seats, the doors are closed by the operator and the platforms are retracted to their safe positions outside of the operating envelope of the ride cabin. Thereafter, the system safety sensors provide input to the ride control computer that all doors have been properly closed and platforms have been retracted and the passenger restraints are latched for the occupied seats. When the operator manually requests a ride start and the Ride Control Computer determines that it is safe to do so, the ride control computer can begin the amusement ride.

While those skilled in the art will appreciate that a variety of programs and computers may be used to achieve the results required of the ride control computer 16, a practical embodiment of the present invention incorporates the use of an double redundant programmable controllers. A copy of the source code in the ladder logic written for the ride control computer of the above described embodiment is attached hereto as Appendix A. Those skilled in the art will appreciate that a variety of computers and programming languages may be used to provide the sequences of operation and the safety interlocks described above.

From the above it may be seen that the present invention provides a highly safe, reliable efficient and economical means of rapidly accessing a moving base simulator used as an amusement ride. While a specific preferred embodiment of the invention has been disclosed, and a few variations in configurations of various important components discussed, those skilled in the art will appreciate that a variety of modifications and alterations may be made without departing from the spirit and scope of the invention. Accordingly, it is not intended that the invention be limited, except as provided by the appended claims.

We claim:

1. A system for providing passenger ingress and egress in an amusement ride having a passenger cabin movable within a operating envelope and an enclosure outside the operating envelope, said system comprising:

a plurality of first doors arranged on surfaces of said cabin, said doors providing access to ingress and egress paths within said cabin;

a plurality of second doors arranged on surfaces of said enclosure, said second doors being substantially in alignment with said first doors when said cabin is in a loading position;

a plurality of retractable platforms, each of said platforms comprising a pivotable bridge pivoting between a retracted position outside the operating envelope of said cabin and a deployed position aligned with and connecting said first doors of said cabin and said second doors of said enclosure when said cabin is in said loading position; and control means for controlling and coordinating the opening of said first doors and said second doors and the pivoting of said platforms so as to enable rapid passenger ingress and egress to and from said cabin when said cabin is in said loading position.

2. The system of claim 1, wherein said first doors of said cabin comprises a plurality of egress doors located on a first surface of said cabin and a plurality of egress doors located on a second surface of said cabin.

3. The system of claim 2, wherein said ingress and egress doors of said cabin are aligned with said ingress and egress paths in said cabin.

4. The system of claim 2, wherein said second doors in said enclosure comprise a plurality of ingress doors located on a first surface of said enclosure and a plurality of egress doors located on a second surface of said enclosure.

5. The system of claim 4, wherein said platforms comprise a pivotable ingress bridge pivoting between a retracted position outside the operating envelope of said cabin and a deployed position aligned with and connecting said ingress doors of said cabin and said ingress doors of said enclosure when said cabin is in said loading position, and a pivotable egress bridge pivoting between a retracted position outside the operating envelope of said cabin and a deployed position aligned with and connecting said egress doors of said cabin and said egress doors of said enclosure when said cabin is in said loading position.

6. The system of claim 5, wherein said control means coordinates and controls the pivoting of said bridges to the deployed position and the opening of all of said doors to provide access to said cabin when said cabin is in said loading position and to close all of said doors and to pivotally retract said bridges to the retracted position in a coordinated manner to provide a clear path for motion of said cabin.

7. The system of claim 5, wherein said cabin includes a plurality of seats and said system further comprises restraint means for restraining passengers in said seats when said cabin is in motion.

8. The system of claim 7, wherein said control means further controls said restraint means and prevents release of said restraint means when said cabin is in motion.

9. The system of claim 7, wherein said control means controls and coordinates the actuation of said doors, said bridges and said restraint means to provide a system affording rapid passenger ingress and egress to said cabin after it has come to said loading position and to prevent deployment of said system or release of said restraint means when said cabin is in motion.

10. The system of claim 9, wherein said control means comprises an electronic computer.

11. The system of claim 10, wherein said electronic computer further comprises an electronic digital computer.

12. The system of claim 1, wherein said cabin is capable of motion in multiple degrees of freedom within said enclosure.

13. A method of providing passenger ingress and egress in an amusement ride having a movable passenger cabin and an enclosure surrounding the envelope of motion of said cabin, the method comprising the steps of:

bringing the passenger cabin of the amusement ride to a loading position;

pivoting bridges which are pivotally connected to said enclosure from a position outside the operating envelope of said cabin to a position aligned with ingress and egress doors located on surfaces of said passenger cabin and said enclosure;

sensing the correct alignment of said passenger cabin, said bridges and said ingress and egress doors;

opening said ingress and egress doors to provide access to said cabin;

closing said ingress and egress doors to prevent access to said cabin; and pivotally retracting said bridges to a retracted position outside the operating envelope of said passenger cabin.

14. The method of claim 13, further comprising the steps of:

sensing the condition of restraint systems for passengers seated in said cabin after the step of opening said ingress and egress doors to provide access to said cabin;

closing said ingress and egress doors upon sensing that all such restraint systems are actuated for each occupied seat; and retracting said bridges to a position outside the operating envelope of said cabin.

* * * * *